US012246909B1

(12) United States Patent
Bruno

(10) Patent No.: US 12,246,909 B1
(45) Date of Patent: Mar. 11, 2025

(54) PACKAGING BOX FOR OUTBOARD MOTOR

(71) Applicant: Brunswick Corporation, Mettawa, IL (US)

(72) Inventor: Corey L. Bruno, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 102 days.

(21) Appl. No.: 18/106,593

(22) Filed: Feb. 7, 2023

(51) Int. Cl.
*B65D 85/68* (2006.01)
*B65D 25/28* (2006.01)

(52) U.S. Cl.
CPC ..... *B65D 85/68* (2013.01); *B65D 25/2802* (2013.01); *B65D 2585/6877* (2013.01)

(58) Field of Classification Search
CPC .... B65D 25/28; B65D 25/2802; B65D 85/68; B65D 2565/6877
USPC ..... 206/319; 220/476, 480–483; 229/117.09, 117.18, 117.19, 117.23, 229/117.24, 117.25; 248/640–643
See application file for complete search history.

(56) References Cited

U.S. PATENT DOCUMENTS

| | | | | |
|---|---|---|---|---|
| 959,823 | A * | 5/1910 | Walch | 229/117.09 |
| 2,249,270 | A | 7/1941 | Boeye | |
| 2,348,964 | A * | 5/1944 | Dodson | A45C 3/04 383/20 |
| 2,515,428 | A | 7/1950 | Scott et al. | |
| 2,733,851 | A | 2/1956 | Van Ness | |
| 2,791,322 | A | 5/1957 | Boeye | |
| 2,817,436 | A | 12/1957 | Simpson | |
| 2,843,258 | A | 7/1958 | Boeye | |
| 3,006,462 | A | 10/1961 | Boeye et al. | |
| 3,176,948 | A | 4/1965 | Wolford | |
| 3,177,001 | A | 4/1965 | Wolford | |
| 3,601,251 | A | 8/1971 | Schwaner | |
| 3,810,573 | A | 5/1974 | Russell et al. | |
| 3,850,363 | A | 11/1974 | Jacobs | |
| 4,508,219 | A | 4/1985 | O'Neill | |

(Continued)

FOREIGN PATENT DOCUMENTS

| | | | |
|---|---|---|---|
| CA | 452544 | A | 11/1948 |
| CN | 113479451 | A | 10/2021 |

(Continued)

OTHER PUBLICATIONS

"These mattress boxes have wheels built in for easier transport", 2020, https://www.reddit.com/r/mildlyinteresting/comments/f3geag/these_mattress_boxes_have_wheels_built_in_for/, accessed Jul. 6, 2022, 21 pages.

(Continued)

*Primary Examiner* — Bryon P Gehman
(74) *Attorney, Agent, or Firm* — Andrus Intellectual Property Law, LLP

(57) ABSTRACT

An outboard motor packaging assembly includes a container configured to receive an outboard motor therein; a carrier configured to hold the outboard motor securely within the container; and at least one auxiliary element configured to be coupled to the carrier so as to mount the carrier, the container, and the outboard motor to a vertical support structure and/or so as to transport the carrier, the container, and the outboard motor over a supporting surface.

20 Claims, 5 Drawing Sheets

(56) References Cited

U.S. PATENT DOCUMENTS

| | | | | |
|---|---|---|---|---|
| 4,687,094 | A * | 8/1987 | Allsop | B65D 5/52 206/774 |
| 4,756,413 | A | 7/1988 | Gits | |
| 4,792,041 | A | 12/1988 | Grigsby | |
| 4,832,256 | A | 5/1989 | Grigsby | |
| 4,938,350 | A | 7/1990 | Grigsby | |
| 5,069,338 | A | 12/1991 | Grigsby | |
| 5,275,279 | A | 1/1994 | Grigsby | |
| 5,464,151 | A | 11/1995 | Parker et al. | |
| 5,501,339 | A | 3/1996 | Suzuki et al. | |
| 5,566,960 | A | 10/1996 | McCrory | |
| 5,680,931 | A | 10/1997 | Hashimoto et al. | |
| 5,681,641 | A | 10/1997 | Grigsby et al. | |
| 6,471,180 | B1 | 10/2002 | Cunningham | |
| 6,976,588 | B2 | 12/2005 | Wischusen et al. | |
| 7,066,379 | B2 | 6/2006 | McLeod et al. | |
| 7,293,655 | B2 | 11/2007 | Messinger | |
| 7,413,077 | B2 | 8/2008 | Rydberg et al. | |
| 7,455,215 | B2 | 11/2008 | McLeod et al. | |
| 9,611,068 | B2 | 4/2017 | Bitner | |

FOREIGN PATENT DOCUMENTS

| | | | |
|---|---|---|---|
| EP | 2036801 | A2 | 3/2009 |
| JP | 2000344238 | A | 6/1999 |

OTHER PUBLICATIONS

Designboom, "Move it cardboard cart", Aug. 11, 2010, https://designboom.com/design/move-it-cardboard-cart/, accessed Jul. 6, 2022, 8 pages.

Barrett, Wil, "The Bike Box Roller converts your cardboard box into a travel case on wheels", May 7, 2019, https://singletrackworld.com/2019/05/the-bike-box-roller-converts-your-cardboard-box-into-a-travel-case-on-wheels/, accessed Jul. 6, 2022, 9 pages.

* cited by examiner

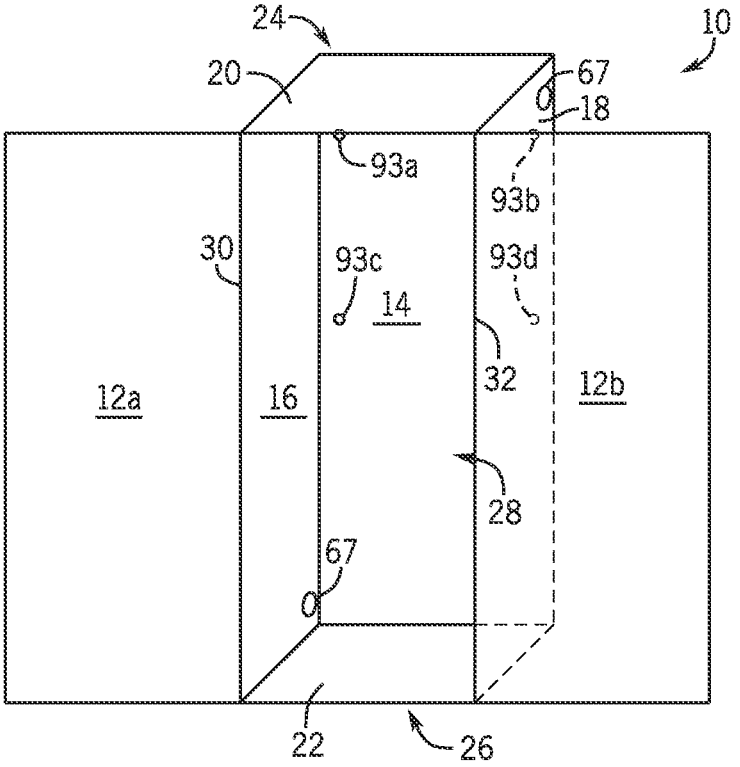
FIG. 3
FIG. 4
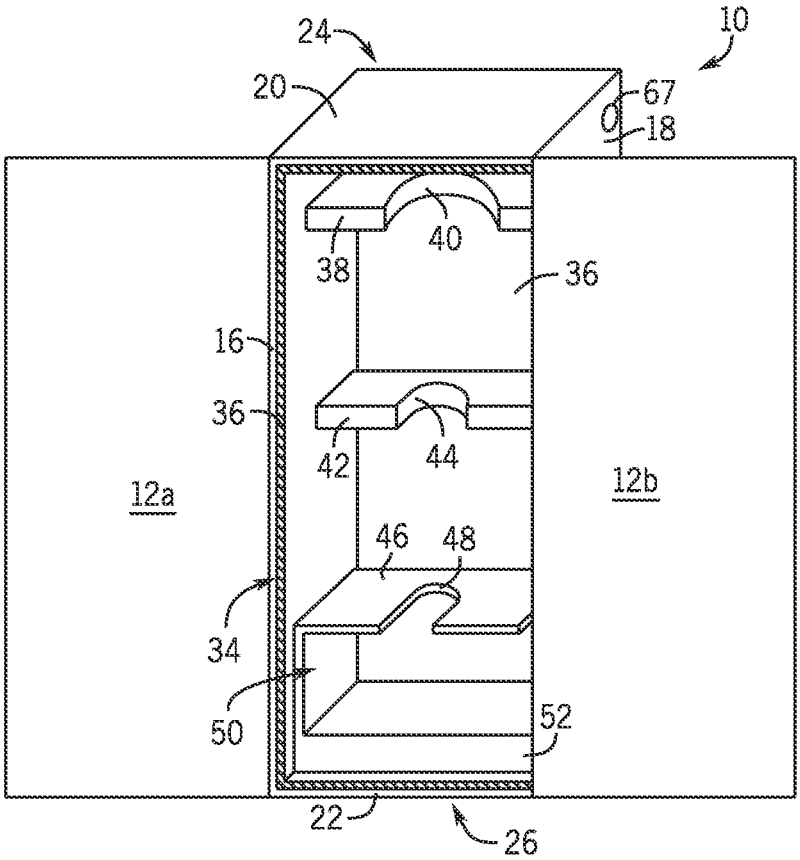

PACKAGING BOX FOR OUTBOARD MOTOR

FIELD

The present disclosure relates to assemblies for shipping, transporting, and storing outboard motors.

BACKGROUND

Display, storage, and/or transportation racks for outboard motors are typically assemblies sold or provided separately from the outboard motor. With the rise in popularity of "transportable" outboard motors, which can easily be removed from a boat and moved elsewhere for use or storage, assemblies for transportation and storage of an outboard motor have become more important.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

According to one embodiment, a packaging box for an outboard motor includes a front wall, a back wall, a left wall, and a right wall connected so as to form a cuboid structure. At least one mounting structure is located inside the cuboid structure. The at least one mounting structure is configured to hold an outboard motor securely within the cuboid structure. The at least one mounting structure is also configured to be coupled to at least one auxiliary element such that the packaging box can be mounted to a vertical support structure and/or transported over a supporting surface by way of the at least one auxiliary element.

According to one aspect, the packaging box further comprises at least one reinforcing element coupled to the at least one mounting structure and configured to interface with the at least one auxiliary element. The at least one reinforcing element may comprise a body having an aperture extending therethrough, the aperture being configured to receive a portion of the at least one auxiliary element therein.

According to one aspect, the at least one mounting structure comprises a lower mounting structure located adjacent a lower end of the packaging box, and the at least one auxiliary element comprises an axle configured to be coupled to the lower mounting structure.

According to one aspect, the at least one mounting structure comprises an upper mounting structure located adjacent an upper end of the packaging box, and the at least one auxiliary element comprises a handle configured to be coupled to the upper mounting structure. The handle may comprise a first crosspiece configured to be spaced from the packaging box when the handle is coupled to the upper mounting structure and a second crosspiece spaced from the first crosspiece and configured to interface with the back wall of the packaging box.

According to one aspect, the at least one auxiliary element comprises one or more fasteners configured to mount the packaging box to the vertical support structure. The at least one mounting structure may be located adjacent the back wall of the packaging box and comprises one or more apertures respectively configured to receive the one or more fasteners therethrough.

According to one aspect, the front wall is movable so as to expose an interior of the packaging box.

According to one aspect, the front, back, left, and right walls are made of corrugated cardboard, and the at least one mounting structure is made of at least one of corrugated cardboard, plastic, and foam.

According to one aspect, the at least one mounting structure is configured to support the outboard motor while the packaging box is mounted to the vertical support structure and/or transported over the supporting surface.

According to one embodiment, an outboard motor packaging assembly includes a container configured to receive an outboard motor therein; a carrier configured to hold the outboard motor securely within the container; and at least one auxiliary element configured to be coupled to the carrier so as to mount the carrier, the container, and the outboard motor to a vertical support structure and/or so as to transport the carrier, the container, and the outboard motor over a supporting surface.

According to one aspect, the packaging assembly further comprising at least one reinforcing element coupled to the carrier and configured to interface with the at least one auxiliary element. The at least one reinforcing element may comprise a body having an aperture extending therethrough, the aperture being configured to receive a portion of the at least one auxiliary element therein.

According to one aspect, the at least one auxiliary element comprises an axle configured to be coupled to the carrier.

According to one aspect, the at least one auxiliary element further comprises a handle configured to be coupled to the carrier. The handle may comprise a first crosspiece configured to be spaced from the container when the handle is coupled to the carrier and a second crosspiece spaced from the first crosspiece and configured to interface with a wall of the container.

According to one aspect, the at least one auxiliary element comprises one or more fasteners configured to mount the carrier, the container, and the outboard motor to the vertical support structure. The carrier comprises one or more apertures respectively configured to receive the one or more fasteners therethrough. The container may be openable while the container is mounted to the vertical support structure so as to allow for removal of the outboard motor from the container.

BRIEF DESCRIPTION OF THE DRAWINGS

The present disclosure is described with reference to the following Figures. The same numbers are used throughout the Figures to reference like features and like components.

FIG. 3 is a top front perspective view showing the packaging box in an open configuration.

FIG. 4 is a view like FIG. 3, but with at least one mounting structure installed in the packaging box.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including." "comprising." or "having" and variations thereof herein is meant to encompass the items listed thereafter and equivalents thereof as well as additional items.

Unless otherwise specified or limited, the phrases "at least one of A, B, and C," "one or more of A, B, and C." and the like, are meant to indicate A, or B, or C, or any combination of A. B. and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings.

As used herein, unless otherwise limited or defined, discussion of particular directions is provided by example only, with regard to particular embodiments or relevant illustrations. For example, discussion of "top," "bottom," "front." "back," "left," "right," "lateral" or "longitudinal" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements from another.

Figure 1:
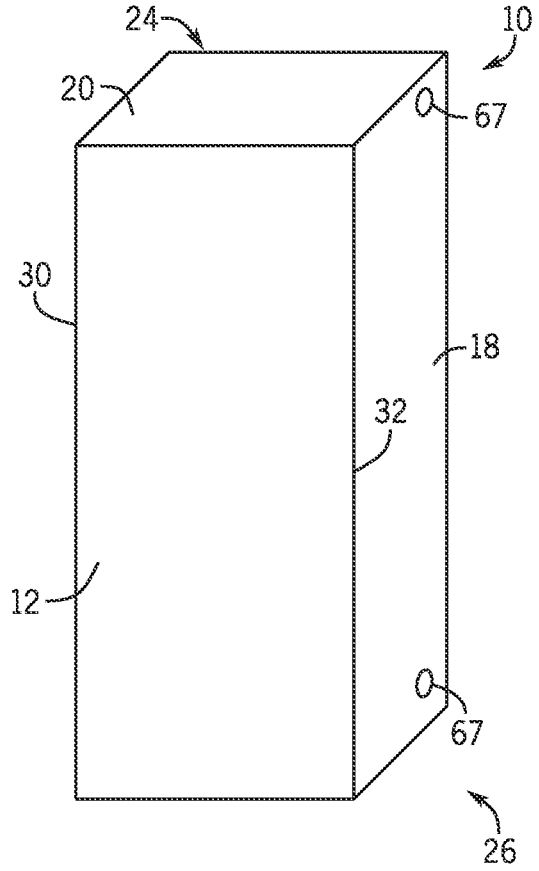
FIG. 1 is a top front perspective view of a packaging box for an outboard motor.
Figure 2:
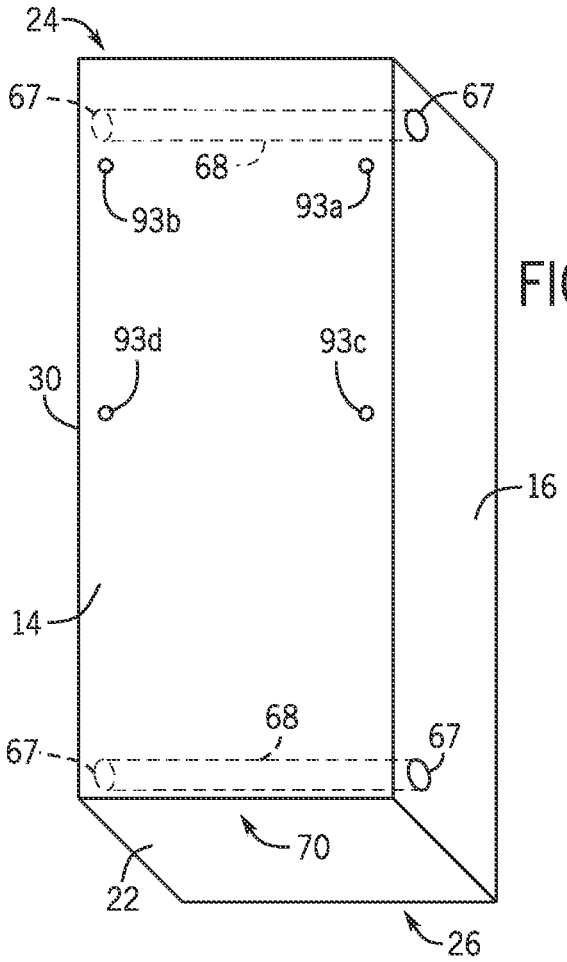
FIG. 2 is a bottom rear perspective view of the packaging box of FIG. 1.

FIG. 1 is a top front perspective view of a packaging box 10 for an outboard motor (not shown), and FIG. 2 is a bottom rear perspective view thereof. The packaging box 10 is shown in a closed configuration, such as it would be when used to ship an outboard motor (e.g., from a manufacturer to a retailer or customer), and comprises a front wall 12, a back wall 14, a left wall 16, and a right wall 18 connected so as to form a cuboid structure. The packaging box 10 also includes a top wall 20 at an upper end 24 thereof and a bottom wall 22 at a lower end 26 thereof. The walls 12, 14, 16, 18, 20, 22 may be connected along their edges as is known in the art of package-making. For example, if the packaging box 10 is made of corrugated cardboard, the edges are defined by folds in the structure of the corrugated board. In such an example, each of the walls 12, 14, 16, 18, 20, 22 may have a single layer or a double layer, depending on the extent to which flaps of the corrugated board have been folded over one another to form the cuboid structure.

In the orientation shown here, the packaging box 10 is taller (from upper end 24 to lower end 26) than it is wide (from side to side). This matches the in-use orientation of an outboard motor to be packaged inside the packaging box 10. It should be understood that the packaging box 10 can be turned on its side such that the front wall 12, back wall 14, left wall 16, or right wall 18 is the upper end, and the opposite wall is the lower end. Further, it should be understood that the packaging box 10 could be rotated such that the front wall 12 no longer faces a user and is instead the left, right, or back wall. Thus, the designation of the walls as top/bottom, left/right, or front/back is arbitrary.

FIG. 3 shows the packaging box 10 in an open configuration in which an interior 28 of the packaging box 10 is visible. The front wall 12 is movable so as to expose the interior 28 of the packaging box 10. More specifically, front wall panel 12*a* of front wall 12 and front wall panel 12*b* of front wall 12 are pivoted about scored edges 30, 32 (like doors on hinges) to reveal the interior 28 of the packaging box 10. Note that in the closed configuration of the packaging box 10 shown in FIG. 1, front wall panel 12*a* and front wall panel 12*b* overlap one another to form front wall 12, and either front wall panel 12*a* or front wall panel 12*b* may be located on the exterior of the packaging box 10 in the closed configuration.

The interior 28 of the packaging box 10 is empty in FIG. 3 so that the back wall 14 and left wall 16 can be seen. In contrast, in FIG. 4, at least one mounting structure 34 is located inside the cuboid structure of the packaging box 10. The at least one mounting structure 34 is configured to hold an outboard motor securely within the cuboid structure. The at least one mounting structure 34 optionally includes an inner sleeve 36 lining the inside face of each of the left wall 16, the top wall 20, the bottom wall 22, and (although not shown in this view) the right wall 18. The inner sleeve 36 can be made of corrugated cardboard, paperboard, or another type of semi-rigid material that reinforces the outer walls of the packaging box 10. The inner sleeve 36 may be held in the interior 28 of the packaging box 10 by a friction fit or may be adhered to the inner faces of the walls 16, 18, 20, 22 with which it interfaces.

The at least one mounting structure 34 also comprises an upper mounting structure 38 located adjacent the upper end 24 of the packaging box 10. The upper mounting structure 38 may include a depression 40 formed therein for receiving a powerhead section of the outboard motor. The at least one mounting structure 34 may also include an intermediate mounting structure 42 located about midway between the upper end 24 and the lower end 26 of the packaging box 10. The intermediate mounting structure 42 may also include a depression 44, which is configured to receive a midsection of the outboard motor. Although only one intermediate mounting structure 42 is shown, more than one may be provided as needed to support the outboard motor. The at least one mounting structure 34 also comprises a lower mounting structure 46 located adjacent the lower end 26 of the packaging box 10. The lower mounting structure 46 also includes a depression 48, which is configured to receive a steering shaft of the outboard motor. A hollow 50 within the lower mounting structure 46 is configured to receive the propeller of the outboard motor. A lowermost portion 52 of the lower mounting structure 46 below the hollow 50 will be described further herein below.

Each portion of the at least one mounting structure 34 can be made of suitable materials such as foam, corrugated cardboard, paperboard, or plastic. In one example, the upper mounting structure 38 and the intermediate mounting structure 42 are made of foam, while the lower mounting structure 46 is made of corrugated cardboard or paperboard. In some instances, mirror images of some or all of the mounting structures 38, 42, 46 may be provided for wedging between the outboard motor and the folded-over front wall panels 12*a*. 12*b* to prevent shifting of the outboard motor during shipping.

Figure 5:
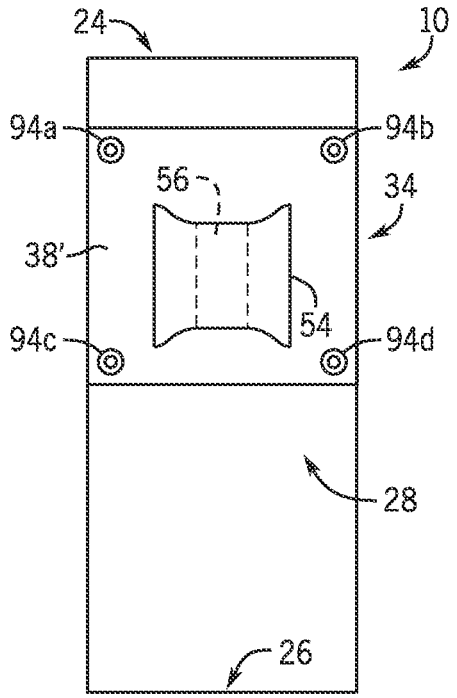
FIG. 5 shows an alternative embodiment of an upper mounting structure in the packaging box.

FIG. 5 shows an alternative embodiment of an upper mounting structure 38' located in the interior 28 of the packaging box 10. The upper mounting structure 38' is a piece of foam, corrugated cardboard, or plastic into which has been built or onto which has been attached a cradle 54. The cradle 54 has an aperture 56 that extends from top to bottom of the cradle 54, as shown in phantom in FIG. 6. The aperture 56 is configured to receive a probe-like portion of the outboard motor. Such a probe-like portion of the outboard motor may enable easy installation and removal of the outboard motor with respect to a transom bracket that remains attached to the boat while the remainder of the outboard motor is removed. Examples of an outboard motor with such a probe-like mounting portion are provided in U.S. patent application Ser. Nos. 17/487,116; 17/509,739; 17/852,944; 17/884,355; 17/960,614; and Ser. No. 17/960,623, each of which is hereby incorporated by reference herein. The probe of the outboard motor can be slid downwardly within the aperture 56 of the cradle 54, thereby suspending the outboard motor from the cradle 54 within the interior 28 of the packaging box 10. The upper mounting structure 38' may be provided with the same intermediate mounting structure 42 and lower mounting structure 46 as shown in FIG. 4, or may be provided alone in the interior 28 of the packaging box 10 as shown in FIG. 5.

According to the present disclosure, the at least one mounting structure 34 is configured to be coupled to at least one auxiliary element (discussed herein below) such that the packaging box 10 can be mounted to a vertical support structure and/or transported over a supporting surface by way of the at least one auxiliary element.

Figure 7:
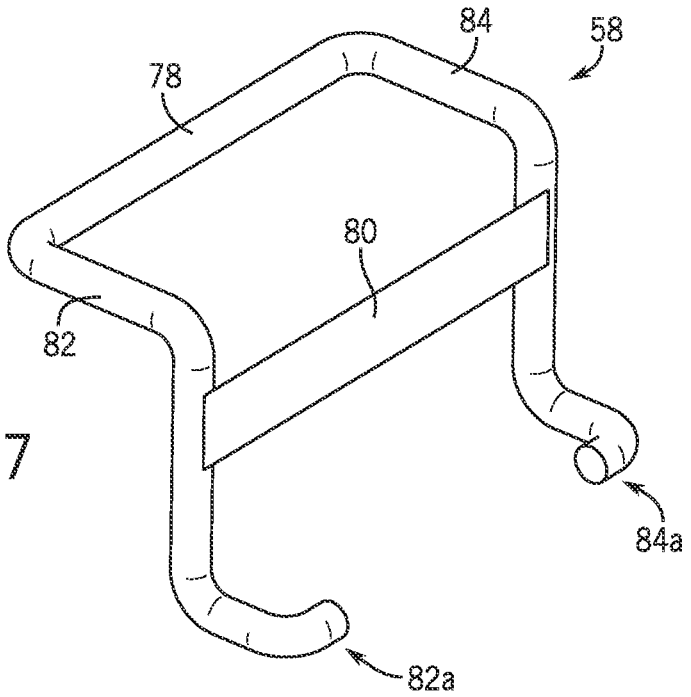
FIG. 7 shows one embodiment of a handle for attachment to the packaging box.
Figure 8:
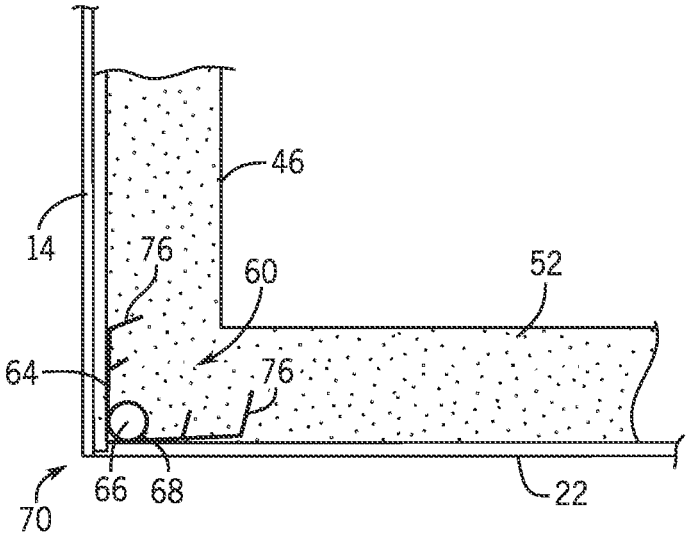
FIG. 8 shows one embodiment of a reinforcing element for the packaging box.
Figure 9:
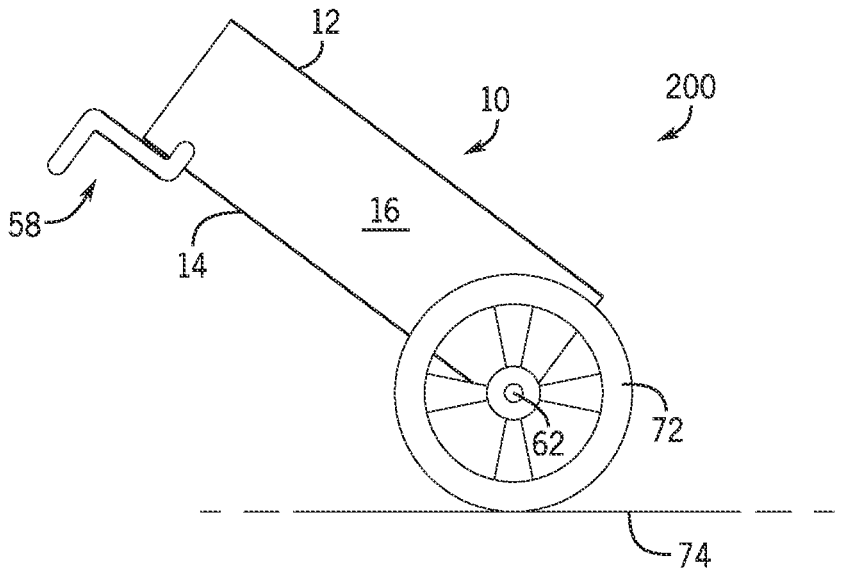
FIG. 9 shows the packaging box with a handle, an axle, and wheels installed.

An embodiment in which the packaging box 10 can be transported over a supporting surface by way of the at least one auxiliary element will be described with respect to FIGS. 7-9. In such an embodiment, the at least one auxiliary element comprises an axle 62 configured to be coupled to the lower mounting structure 46, and optionally a handle 58 configured to be coupled to the upper mounting structure 38, 38'. As shown in FIG. 8, which is a partial cross-sectional view through the lower rear edge 70 of the packaging box 10, at least one reinforcing element 60 is coupled to the at least one mounting structure (here, the lower mounting structure 46) and configured to interface with the at least one auxiliary element. Specifically, the reinforcing element 60 comprises an L-shaped body 64 made of plastic or another rigid material and having an aperture 66 extending therethrough. The aperture 66 may be defined by a tube 68 that is formed integrally with the L-shaped portion of the body 64 or that is attached to the body 64 by adhesive or welding. The aperture 66 is configured to receive a portion of the at least one auxiliary element therein, such as the axle 62. For example, the tube 68 may be configured to abut against or project through the left and right walls 16, 18 of the packaging box 10, as shown in FIG. 2. Corresponding apertures 67 in the left and right walls 16, 18 allow for the axle 62 to be inserted through the walls 16, 18 and into the tube 68. The axle 62 can be preconnected to a pair of wheels 72 or can be configured to be connected to the wheels 72 for transporting of the packaging box 10 over a supporting surface 74, as shown in FIG. 9.

The reinforcing element 60 may extend across the entire back wall 14 of the packaging box 10 along the lower rear edge 70 thereof. The axle 62 may correspondingly extend along the entire width of the packaging box 10, or may comprise two separate axles that are inserted into the tube 68 from either side of the packaging box 10. In other examples, the reinforcing element 60 includes two separate reinforcing elements, one at each lower rear corner of the packaging box 10. The axle 62 may similarly be two separate axles, one inserted into each reinforcing element 60, or may be a single axle inserted through both reinforcing elements 60. The axle(s) 62 may be rotatable within the tube 68, which may comprise a bushing or bearing, such that the wheels 72 can roll on the supporting surface 74. Alternatively, the axle(s) 62 may be provided with bearings that allow the wheels 72 to rotate about the axle(s) 62, which may be stationary with respect to the tube 68.

The body 64 of the reinforcing element 60 may have flanges or other projections (e.g., at 76, FIG. 8) that strengthen the body 64 and help maintain the body 64 upright in the lower mounting structure 46. Especially if the lower mounting structure 46 is made of foam or another relatively compressible material, the flanges 76 add strength, support, and stability to the lower rear edge 70 of the packaging box 10. The reinforcing element 60 may be embedded or otherwise located or housed in the lowermost portion 52 of the lower mounting structure 46 to further strengthen the assembly. In one example, the lowermost portion 52 of the lower mounting structure 46 is a solid piece of foam. The location of the reinforcing element 60 and the aperture 66 defined therein is designed with the size of the wheels 72 in mind. For example, it may be desired that the bottom wall 22 rests on the supporting surface 74 when the packaging box 10 is upright, even with the axle 62 and wheels 72 installed.

While the packaging box 10 is capable of being transported over the supporting surface 74 with only the axle 62 and wheels 72 installed, it may be helpful to also install a handle 58 for easier transportation of the packaging box 10. As shown in FIG. 7, the handle 58 comprises a first crosspiece 78 configured to be spaced from the packaging box 10 when the handle 58 is coupled to the upper mounting structure 38, 38' and a second crosspiece 80 spaced from the first crosspiece 78 and configured to interface with the back wall 14 of the packaging box 10 when the handle 58 is installed so as to transmit loads to the walls of the packaging box 10. The first and second crosspieces 78, 80 are connected by Z-shaped arms 82, 84 at either end thereof. Each Z-shaped arm 82, 84 has an inwardly projecting portion 82*a*, 84*a* configured to connect the handle 58 to the first mounting structure 38, 38'. For example, the first mounting structure 38, 38' includes at least one reinforcing element coupled thereto, which reinforcing element can be the same as or similar to the reinforcing element 60 at the lower rear edge 70 of the packaging box 10. However, instead of running widthwise across the rear wall 14 at the lower rear edge 70 of the packaging box 10, the reinforcing element 60 runs through the upper mounting structure 38, 38' widthwise across the rear wall 14 of the packaging box 10 proximate the upper end 24 thereof, as shown in FIG. 2. The at least one reinforcing element 60 proximate the upper end 24 of the packaging box 10 comprises a body 64 having an aperture 66 extending therethrough (e.g., defined by tube 68), and the aperture 66 is configured to receive a portion of the handle 58 therein. Specifically, the inwardly projecting portion 82*a* of the handle 56 can be inserted into the aperture 66 in the reinforcing element 60 on the left wall 16 of the packaging box 10 (via aperture 67 in left wall 16), while the inwardly projecting portion 84*a* of the handle 58 can be inserted into the aperture 66 in the reinforcing element 60 on the right wall 18 of the packaging box 10 (via aperture 67 in right wall 18). The inwardly projecting portions 82*a*, 84*a* of the handle 58 can be held in the reinforcing elements 60 by way of a friction fit or by way of mechanical devices such as clevis pins, snap rings, or other clips. Note that because only the inwardly projecting portions 82*a*, 84*a* of the handle 58 are inserted into the reinforcing element 60, it may be possible to use two separate reinforcing elements 60, one at each side of the upper mounting structure 38, 38'.

The handle 58 can be made of any suitable material, such as plastic or aluminum. The handle 58 is rigid enough to support the weight of the packaging box 10 with the outboard motor inside, but is flexible enough that the two inwardly projecting portions 82*a*, 84*a* of the handle 58 can be pulled far enough apart from one another to fit them around the side walls 16, 18 of the packaging box 10 and insert them through the apertures 67 in the walls 16, 18 and into the apertures 66 in the reinforcing element 60.

Although the second crosspiece 80 is shown as being located below the first crosspiece 78, in other embodiments, the second crosspiece 80 may support the back wall 14 at the same vertical level as the first crosspiece 78, or the second crosspiece 80 may be located above the first crosspiece 78. Because the user grips the first crosspiece 78 with their hands to push the assembly over the supporting surface 74, different relative arrangements of the first and second crosspieces 78, 80 can allow users of different heights to comfortably grasp the first crosspiece 78 and/or can allow different heights of packaging boxes to be transported. In still other examples of the handle 58, no second crosspiece 80 is provided.

Turning back to FIG. 6 and referring now also to FIG. 10, an embodiment in which the packaging box 10 can be mounted to a vertical support structure will now be described. In this embodiment, the at least one auxiliary element comprises one or more fasteners 86, 88 configured to mount the packaging box 10 to the vertical support structure 90. The vertical support structure 90 could be, for example, a wall or a post. In this instance, the at least one mounting structure 38' is located adjacent the back wall 14 of the packaging box 10 and comprises one or more apertures 92*a-d* respectively configured to receive the one or more fasteners 86, 88 therethrough. Although only fasteners 86, 88 are shown extending through apertures 92*a*, 92*c* in FIG. 10, it would be understood that two more fasteners would be provided through the remaining two apertures 92*b*, 92*d*. In other examples, only two fasteners are provided through apertures 92*a*, 92*b*.

Figure 6:
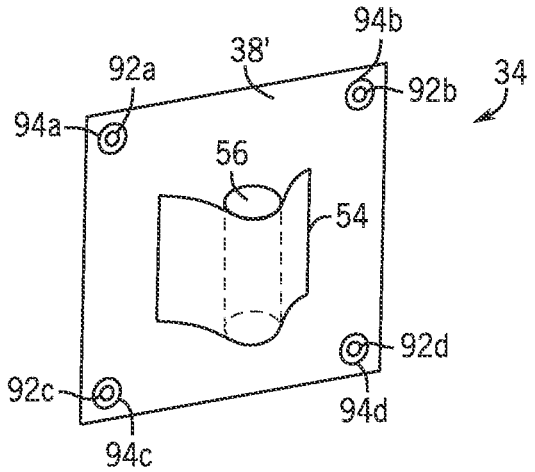
FIG. 6 shows the upper mounting structure of FIG. 5 in isolation.

As shown in FIG. 6, at least one reinforcing element, such as bushings 94*a-d*, are coupled to the upper mounting structure 38' and configured to interface with the at least one auxiliary element in the form of fasteners 86, 88. The bushings 94*a-d* each comprise a body having an aperture 92*a-d* extending therethrough, the aperture 92*a-d* being configured to receive a portion of the at least one auxiliary element in the form of fasteners 86, 88 therein. The bushings 94*a-d* may be helpful if the upper mounting structure 38' is made of a relatively compressible material such as foam, as the bushings 94*a-d* line, prevent wear of, and reinforce the apertures 92*a-d* through which the fasteners 86, 88 are to be inserted. Corresponding apertures 93*a-d* are provided in the rear wall 14 of the packaging box 10, as shown in FIGS. 2 and 3. The fasteners 86, 88 can be inserted through the apertures 92*a-d* in the bushings 94*a-d*, through the apertures 93*a-d* in the rear wall 14, and directly into the vertical support structure 90. In such an example, the fasteners 86, 88 may be screws. Alternatively, the fasteners 86, 88 can be inserted through the apertures 92*a-d* in the bushings 94*a-d*, through the apertures 93*a-d* in the rear wall 14, and then attached to a bracket that has been preinstalled on the vertical support structure 90. In such an example, the fasteners 86, 88 may be pegs, hooks, or the like.

In another embodiment, the upper mounting structure 38' is made of injection molded plastic and does not require reinforcing elements. Instead, fasteners can be inserted directly through apertures in the upper mounting structure 38', through apertures in the back wall 14 of the packaging box 10, and into the vertical support structure 90 or a bracket installed on the vertical support structure 90.

The reinforcing elements and apertures therein for mounting the packaging box 10 to the vertical support structure 90 could instead be provided in the upper mounting structure 38 of FIG. 4. For example, the apertures could be accessible from the lower face of the upper mounting structure 38 by way of recesses provided in the lower face. The recesses would be deep enough (in a front-to-back direction) to accommodate insertion of the fasteners therein vertically, which fasteners would then be slid horizontally through the apertures in the upper mounting structure 38 and fastened into the vertical support structure 90. In another example, the reinforcing elements could be rigid tabs that extend upwardly from the top of the upper mounting structure 38 and/or downwardly from the bottom of the upper mounting structure 38. The tabs are provided with apertures for insertion of the fasteners therethrough. The tabs could be connected to the upper mounting structure 38 by being embedded therein and/or by way of adhesive. Alternatively, the tabs could be formed on brackets that fit over the rear end of the upper mounting structure 38, which is sandwiched between upper and lower portions of the brackets. Such tabs would eliminate the need for forming recesses in the upper mounting structure 38 itself.

In some embodiments, reinforcing elements and apertures therein could be provided on the intermediate mounting structure 42 as well as on the upper mounting structure 38. The reinforcing elements and apertures on the intermediate mounting structure 42 would be the same as those described hereinabove with respect to the upper mounting structure 38. This may provide further points of connection of the at least one mounting structure 34 to the vertical support structure 90, which may be desired if the outboard motor is particularly heavy.

Figure 10:
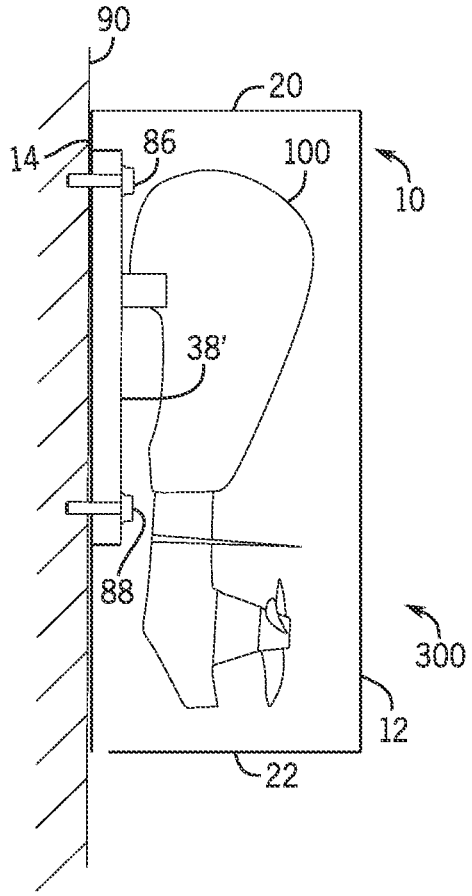
FIG. 10 shows the packaging box mounted to a vertical support structure.

As shown in FIG. 10, the at least one mounting structure (e.g., upper mounting structure 38') is configured to support an outboard motor 100 while the packaging box 10 is mounted to the vertical support structure 90. Although the outboard motor is not shown in FIG. 9, the at least one mounting structure 34 is also configured to support an outboard motor 100 while the packaging box 10 is transported over the supporting surface 74. In this way, the same packaging box 10 that was used to ship the outboard motor 100 from the manufacturer to the retailer or buyer is repurposed as a means of transporting the outboard motor 100 easily and as a means for storing the outboard motor 100 off the ground when it is not in use. The packaging box 10 protects the outboard motor 100 from dust and other external elements while it is being transported or stored. A separate dolly or stand is not required.

Thus, referring to all the FIGS. together, the present disclosure is of an outboard motor packaging assembly (200, FIG. 9; 300, FIG. 10) comprising a container 10 configured to receive an outboard motor 100 therein. A carrier 34 (including one or more of mounting structures 38, 38', 42, and 46) is configured to hold the outboard motor 100 securely within the container 10. At least one auxiliary element (e.g., handle 58, axle 62 and wheels 72, and/or fasteners 86, 88) is configured to be coupled to the carrier 34 so as to mount the carrier 34, the container 10, and the outboard motor 100 to a vertical support structure 90 and/or so as to transport the carrier 34, the container 10, and the outboard motor 100 over a supporting surface 74.

According to one aspect, at least one reinforcing element 60, 94*a-d* is coupled to the carrier 34 and configured to interface with the at least one auxiliary element 58, 62, 86, 88. The at least one reinforcing element 60, 94*a-d* comprises a body having an aperture 66, 92*a-d* extending therethrough, the aperture 66, 92*a-d* being configured to receive a portion of the at least one auxiliary element 58, 62, 86, 88 therein.

In one aspect, the at least one auxiliary element comprises an axle 62 configured to be coupled to the carrier 34. In one aspect, the at least one auxiliary element further comprises a handle 58 configured to be coupled to the carrier 34. The handle 58 may comprise a first crosspiece 78 configured to be spaced from the container 10 when the handle 58 is coupled to the carrier 34 and a second crosspiece 80 spaced from the first crosspiece 78 and configured to interface with a wall (e.g., back wall 14) of the container 10. In other examples, the handle 58 may be attached to the top wall 20 and/or may interface with the left and/or right walls 16, 18 of the packaging box 10 instead. In another aspect, instead of an auxiliary handle 58, handles that are cut out in the side walls 16, 18 of the container 10 could be used to grasp the container 10 while rolling it over the supporting surface 74.

In another aspect, the at least one auxiliary element comprises one or more fasteners 86, 88 configured to mount the carrier 34, the container 10, and the outboard motor 100 to the vertical support structure 90. The carrier 34 may comprise one or more apertures 92*a-d* respectively configured to receive the one or more fasteners 86, 88 therethrough. Although the apertures 92*a-d* and fasteners 86, 88 in the present embodiment are shown as extending through the upper mounting structure 38', they may additionally be provided in at least one of the intermediate mounting structure 42 and/or the lower mounting structure 46 to provide further points of attachment to the vertical support structure 90. In one aspect, the container 10 is openable while the container 10 is mounted to the vertical support structure 90 so as to allow for removal of the outboard motor 100 from the container 10. That is, because the container 10 is mounted to the vertical support structure 90 via the back wall 14, the front wall 12 can be opened by folding the front wall flaps 12*a*. 12*b* along the respective scored edges 30, 32 to expose the interior 28 of the container 10, as shown in FIGS. 3 and 4. The outboard motor 100 can then be removed from the carrier 34 for use, and later replaced on the carrier 34 for storage.

As noted hereinabove, in one embodiment, the front, back, left, and right walls 12, 14, 16, 18 are made of corrugated cardboard, and the at least one mounting structure 34 is made of at least one of corrugated cardboard, plastic, foam, pressed board, or molded pulp. However, other suitable materials for the front, back, left, and right walls 12, 14, 16, 18 include composites, and other suitable materials for the at least one mounting structure 34 include lightweight metals. The ability to re-use the container 10 cuts down on waste and avoids the need for the consumer to dispose of the shipping packaging.

It should be understood that any of the mounting structures 38, 38', 42, 46 could be used alone or together in the container 10. Further, the container 10 may be provided with a mounting structure that allows for attachment of auxiliary element(s) that facilitate transporting the container over a supporting surface and/or with a mounting structure that accommodates auxiliary element(s) that mount the container 10 to a vertical support structure. The mounting structure that attaches to or accommodates such auxiliary elements need not look the same or be located in the same place in the container 10 as the example mounting structures shown herein.

In the above description, certain terms have been used for brevity, clarity, and understanding. No unnecessary limitations are to be inferred therefrom beyond the requirement of the prior art because such terms are used for descriptive purposes and are intended to be broadly construed. The different assemblies described herein may be used alone or in combination with other systems and methods. It is to be expected that various equivalents, alternatives and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

What is claimed is:

1. A packaging box for an outboard motor, the packaging box comprising:

a front wall, a back wall, a left wall, and a right wall connected so as to form a cuboid structure; and at least one mounting structure located inside the cuboid structure, the at least one mounting structure configured to hold an outboard motor securely within the cuboid structure;

wherein the at least one mounting structure is configured to be coupled to at least one auxiliary element such that the packaging box can be mounted to a vertical support structure by way of the at least one auxiliary element and such that the packaging box can be transported over a supporting surface by way of the at least one auxiliary element.

2. The packaging box of claim 1, further comprising at least one reinforcing element coupled to the at least one mounting structure and configured to interface with the at least one auxiliary element.

3. The packaging box of claim 2, wherein the at least one reinforcing element comprises a body having an aperture extending therethrough, the aperture being configured to receive a portion of the at least one auxiliary element therein.

4. The packaging box of claim 1, wherein the at least one mounting structure comprises a lower mounting structure located adjacent a lower end of the packaging box, and the at least one auxiliary element comprises an axle configured to be coupled to the lower mounting structure.

5. The packaging box of claim 4, wherein the at least one mounting structure comprises an upper mounting structure located adjacent an upper end of the packaging box, and the at least one auxiliary element comprises a handle configured to be coupled to the upper mounting structure.

6. The packaging box of claim 5, wherein the handle comprises a first crosspiece configured to be spaced from the packaging box when the handle is coupled to the upper mounting structure and a second crosspiece spaced from the first crosspiece and configured to interface with the back wall of the packaging box.

7. The packaging box of claim 1, wherein the at least one auxiliary element comprises one or more fasteners configured to mount the packaging box to the vertical support structure.

8. The packaging box of claim 7, wherein the at least one mounting structure is located adjacent the back wall of the packaging box and comprises one or more apertures respectively configured to receive the one or more fasteners therethrough.

9. The packaging box of claim 8, wherein the front wall is movable so as to expose an interior of the packaging box.

10. The packaging box of claim 1, wherein the front, back, left, and right walls are made of corrugated cardboard, and the at least one mounting structure is made of at least one of corrugated cardboard, plastic, and foam.

11. The packaging box of claim 1, wherein the at least one mounting structure is configured to support the outboard motor while the packaging box is mounted to the vertical support structure and while the packaging box is transported over the supporting surface.

12. An outboard motor packaging assembly comprising:

a container configured to receive an outboard motor therein;

a carrier configured to hold the outboard motor securely within the container; and at least one auxiliary element configured to be coupled to the carrier so as to mount the carrier, the container, and the outboard motor to a vertical support structure and so as to transport the carrier, the container, and the outboard motor over a supporting surface.

13. The packaging assembly of claim 12, further comprising at least one reinforcing element coupled to the carrier and configured to interface with the at least one auxiliary element.

14. The packaging assembly of claim 13, wherein the at least one reinforcing element comprises a body having an aperture extending therethrough, the aperture being configured to receive a portion of the at least one auxiliary element therein.

15. The packaging assembly of claim 12, wherein the at least one auxiliary element comprises an axle configured to be coupled to the carrier.

16. The packaging assembly of claim 15, wherein the at least one auxiliary element further comprises a handle configured to be coupled to the carrier.

17. The packaging assembly of claim 16, wherein the handle comprises a first crosspiece configured to be spaced from the container when the handle is coupled to the carrier and a second crosspiece spaced from the first crosspiece and configured to interface with a wall of the container.

18. The packaging assembly of claim 12, wherein the at least one auxiliary element comprises one or more fasteners configured to mount the carrier, the container, and the outboard motor to the vertical support structure.

19. The packaging assembly of claim 18, wherein the carrier comprises one or more apertures respectively configured to receive the one or more fasteners therethrough.

20. The packaging assembly of claim 19, wherein the container is openable while the container is mounted to the vertical support structure so as to allow for removal of the outboard motor from the container.

* * * * *